US007866290B2

(12) United States Patent
Stubbemann et al.

(10) Patent No.: US 7,866,290 B2
(45) Date of Patent: Jan. 11, 2011

(54) CAMSHAFT ADJUSTER

(75) Inventors: Ulrich Stubbemann, Berlin (DE); Max Von Fromm, Berlin (DE)

(73) Assignee: Daimler AG, Stuttgart (DE)

( * ) Notice: Subject to any disclaimer, the term of this patent is extended or adjusted under 35 U.S.C. 154(b) by 395 days.

(21) Appl. No.: 12/012,517

(22) Filed: Feb. 1, 2008

(65) Prior Publication Data

US 2008/0223322 A1 Sep. 18, 2008

Related U.S. Application Data

(63) Continuation-in-part of application No. PCT/EP2006/005451, filed on Jun. 8, 2006.

(30) Foreign Application Priority Data

Aug. 4, 2005 (DE) ..... 10 2005 036 707

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 60
See application file for complete search history.

(56) References Cited

U.S. PATENT DOCUMENTS

| | | | |
|---|---|---|---|
| 5,870,983 | A | 2/1999 | Sato et al. |
| 6,058,897 | A | 5/2000 | Nakayoshi |

FOREIGN PATENT DOCUMENTS

| | | |
|---|---|---|
| EP | 1 065 348 | 1/2001 |
| EP | 1 128 026 | 8/2001 |
| JP | 01014810 | 1/1989 |
| JP | 11 182214 | 7/1999 |
| JP | 2002317610 | 10/2002 |

*Primary Examiner*—Ching Chang
(74) *Attorney, Agent, or Firm*—Klaus J. Bach

(57) ABSTRACT

In a camshaft adjusting device comprising a locking unit provided for locking an adjustment function component in at least one position relative to a camshaft drive component wherein at least two locking structures are provided which each have at least one locking surface for mutual engagement, each locking structure surface is formed by an at least substantially planar area which is inclined with respect to the direction of movement, the locking unit providing for a play-free engagement between the camshaft drive component and the adjustment function component.

9 Claims, 4 Drawing Sheets

CAMSHAFT ADJUSTER

This is a Continuation-In-Part Application of pending international patent application PCT/EP2006/005451 filed Jun. 8, 2006 and claiming the priority of German patent application 10 2005 036 707.0 filed Aug. 4, 2005.

BACKGROUND OF THE INVENTION

The invention relates to a camshaft adjuster with a locking structure providing a locking function.

JP 10148108 A discloses a camshaft adjusting device of the type in question with a locking unit which has a locking means formed by a bolt and a locking means formed by a plate with a recess. The locking means each have a locking surface provided for mutual engagement. In this case, the locking surfaces are formed by conical inclined surfaces.

It is in particular the object of the present invention to provide a camshaft adjusting device of the type referred to above but which has reduced wear properties.

SUMMARY OF THE INVENTION

In a camshaft adjusting device comprising a locking unit provided for locking an adjustment function component in at least one position relative to a camshaft drive component wherein at least two locking structures are provided which each have at least one locking surface for mutual engagement, each locking structure surface is formed by an at least substantially planar area which is inclined with respect to the direction of movement, the locking unit providing for a play-free engagement between the camshaft drive component and the adjustment function component.

It is proposed that the locking surfaces are formed by planar inclined surfaces, as a result of which an advantageous freedom from play and, in addition, an extensive transmission of force and small surface pressures and therefore a low degree of wear can be obtained. In particular, use can also be made of cost-effective and less hard materials. In this connection, a "locking means" is to be understood as meaning all of the means appearing expedient to a persona skilled in the art, such as, in particular, bolt-shaped locking means, locking means in the form of slotted guides, etc. an "inclined surface" is to be understood in particular as meaning a surface which has an angle not equal to 0 to a plane oriented parallel to a direction of movement of the adjustment function component which is to be locked and to a plane oriented perpendicular to the direction of movement. An "adjustment function component" is to be understood in particular as meaning a component which has a function to obtain an adjusting mechanism, such as, for example, a cover, a vane piston, a housing part, etc. Furthermore, in this context, a "substantially planar inclined surface" is to be understood as meaning in particular also inclined surfaces which have tolerance-induced curvatures and/or curvatures with a radius greater than 10 cm. The inclined surface here may in principle also be formed by a planar stepped surface of a stepped contour with planar steps.

If the locking surfaces have an angle of inclination with respect to the direction of movement of the adjustment function component, which is to be locked, so as to obtain self-locking, an automatic, in particular torque-induced release can advantageously be avoided in a simple manner structurally. An appropriate angle of inclination is determined here essentially from coefficients of friction which are present.

Furthermore, a camshaft adjusting device is proposed with a locking unit which is provided in order to lock an adjustment function component in at least one position, and which comprises at least two locking means which each have at least one locking surface which is provided for mutual engagement, wherein the locking unit has a locking means which is formed by a locking slotted guide and has a plurality of, or at least two, locking positions and at least one locking surface formed by an inclined surface. By means of an appropriate configuration, a stepwise limiting of the movement of an adjustment function component can be obtained, and automatic setting of an advantageous locking position with advantageous play-free locking can be achieved. An undesirable oscillation of an adjustment function component, such as, in particular, of a vane piston, and resultantly caused noises and wear can be avoided.

In a further refinement of the invention, it is proposed that at least one of the locking means has a release surface formed by an inclined surface, as a result of which a material-protecting release and, in particular, automatic finding of an advantageous locking position can be realized in a simple manner. Furthermore, in particular in spite of a locking means which is formed by a locking slotted guide and has a plurality of locking positions, small adjustment distances of a locking means, which correspond with the locking slotted guide, and resultantly caused small bending moments acting on the movably mounted locking means can be obtained. A "release surface" is to be understood here as meaning in particular an inclined surface with an angle of inclination so as to avoid self-locking.

The locking unit preferably has as least one locking means which is formed by a locking bolt and has a locking surface and a release surface, thus enabling a structurally simple mechanism to be obtained. In this case, the locking bolt may have various cross-sectional surfaces appearing expedient to a person skilled in the art, such as angular, polygonal and/or, advantageously, round cross-sectional surfaces, etc.

If the locking unit has at least two locking means which are provided for locking in opposite directions of movement of the adjustment function component which is to be locked, the adjustment function component can advantageously be fixed in any desired position between stops provided on the housing, and, by means of a decoupled activation of the locking means, high flexibility in terms of configuration can be obtained.

Furthermore, additional components, construction space, weight, outlay on installation and costs can be saved if the camshaft adjusting device has an adjustment function component which has integrally formed bearing surfaces for at least one locking means, and/or which has an integrally formed locking slotted guide, and/or if the camshaft adjusting device has at least one spring element which serves for loading at least one locking means and for guiding the same and/or is provided for loading a plurality of locking means. Furthermore, guided by a spring element the corresponding locking means can advantageously be matched in its position to a corresponding locking surface in a play free manner. In this case, "guided" is to be understood as meaning, in particular, biased in a specific orientation in the circumferential direction, in the radial direction and/or in the axial direction during movement of a locking means.

The invention will become more readily apparent from the following description of embodiments thereof on the basis of the accompanying drawing:

DESCRIPTION OF PARTICULAR EMBODIMENTS

Figure 1:
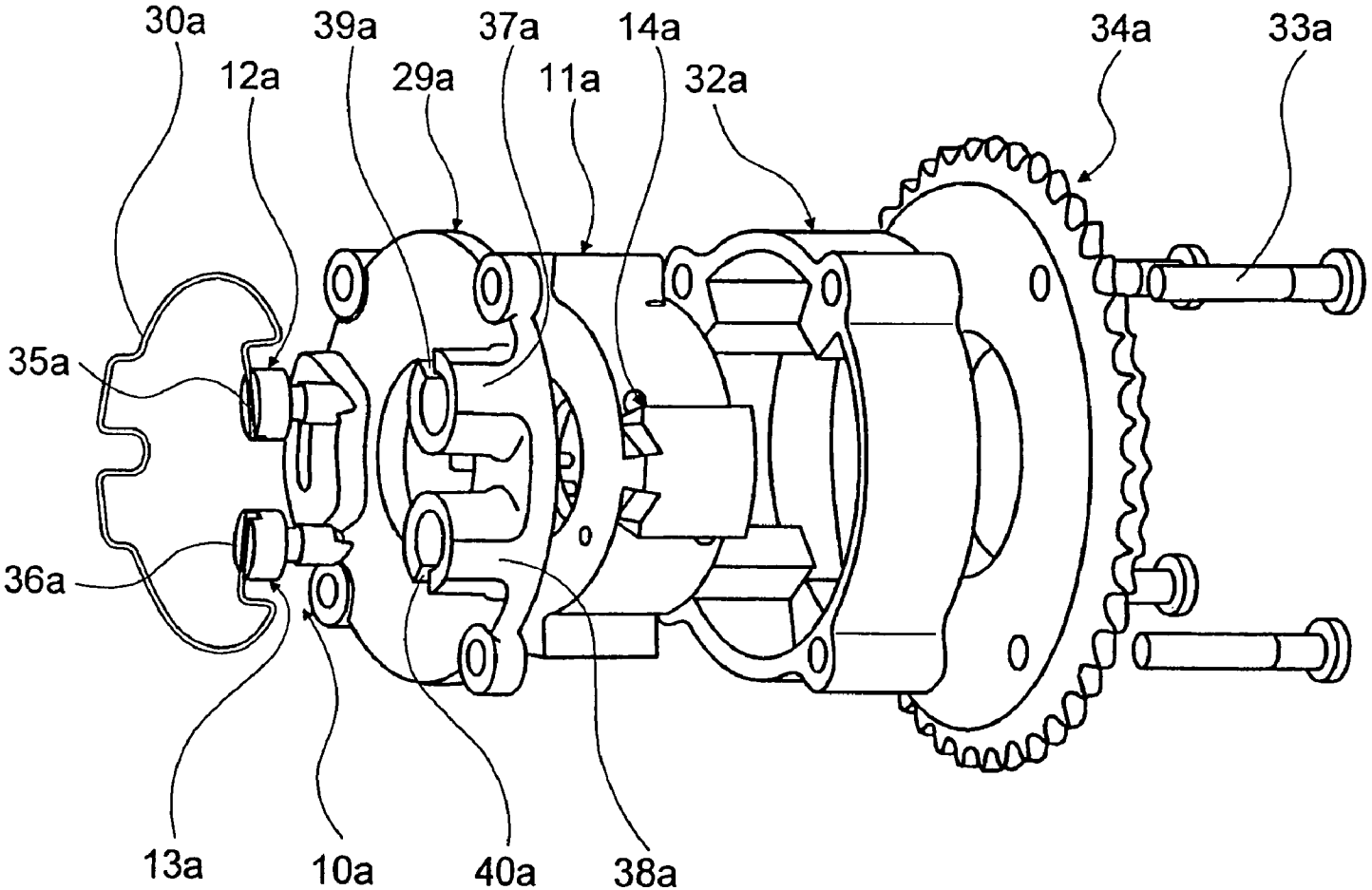
FIG. 1 shows in an exploded a camshaft adjusting device in a three-dimensional illustration.

FIG. 1 shows an exploded drawing of a camshaft adjusting device with a housing 32*a* which, when assembled, is connected in a rotationally fixed manner via fastening screws 33*a* to a chain wheel 34*a* and to an adjustment function component 29*a* formed by a cover. In the installed state of the camshaft adjusting device, the chain wheel 34 is connected in terms of drive to a crankshaft via a chain (not illustrated). An adjustment function component 11*a* which is formed by a vane piston is mounted rotatably in the housing 32*a* and is connected in a rotationally fixed manner to a camshaft (not illustrated).

The camshaft adjusting device has a locking unit 10*a* with two locking means 12*a*, 13*a* which are formed by stepped bolts (35*a*, 36*a*). The bolts are mounted moveably in the axial direction in cylindrical guide channels formed by guide domes 37*a*, 38*a* via bearing surfaces integrally formed on the adjustment function component 29*a*, which is formed by the cover. The guide bolts (33*a*, 36*a*) are provided for locking the adjustment function component 11*a* in opposite directions of movement 27*a*, 28*a* of the adjustment function component 11*a*. The locking means 12*a*, 13*a* are preferably arranged on a common pitch circle, but could in principle also be arranged on different pitch circles. In order to obtain advantageously large bearing surfaces in the axial direction in relation to a cover thickness, the guide domes 37*a*, 38*a* in which the locking means 12*a*, 13*a* are guided are integrally formed on the adjustment function component 29*a*. By the locking means 12*a*, 13*a* being mounted in the adjustment function component 29*a*, which is formed by the cover, the locking means can be arranged on a pitch circle with a large radius, whereby advantageously small supporting forces are obtained. However, as an alternative and/or in addition, at least one locking means could also be mounted in another adjustment function component as it may appear to be expedient to a person skilled in the art. In particular, the locking means may be supported in the adjustment function component 11*a* which is formed by the vane piston and which provides an advantageously large construction space for one or more locking means.

Figure 2:
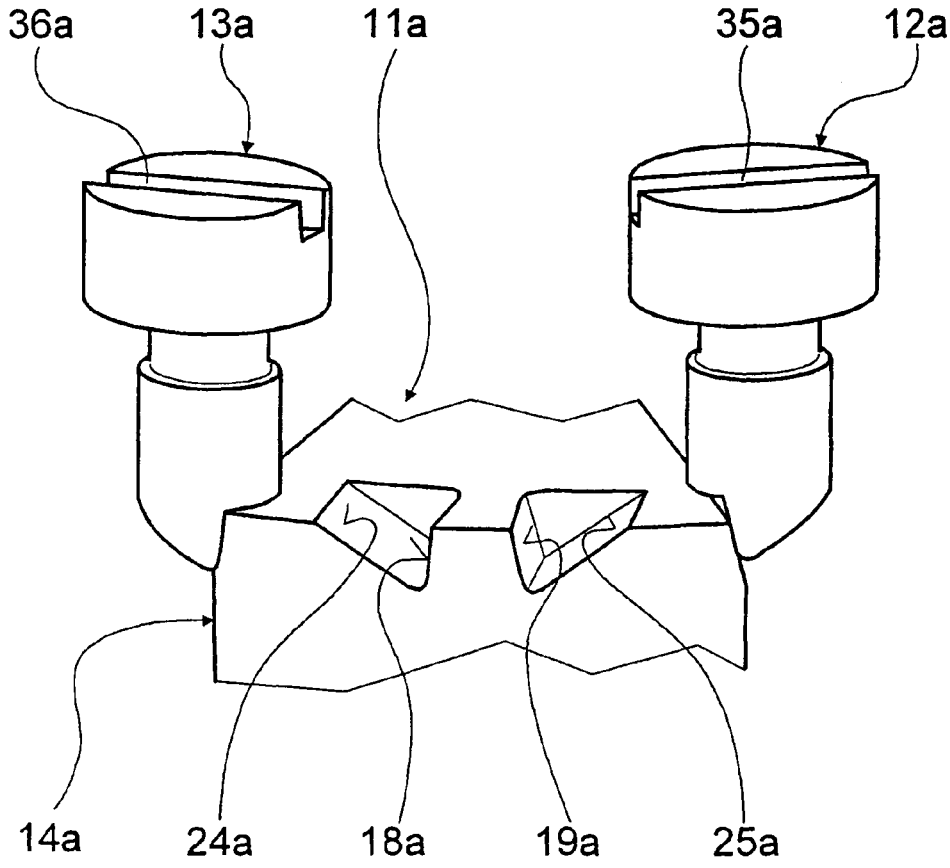
FIG. 2 shows individual parts of the camshaft adjusting device shown in FIG. 1 in a three-dimensional illustration.
Figure 3:
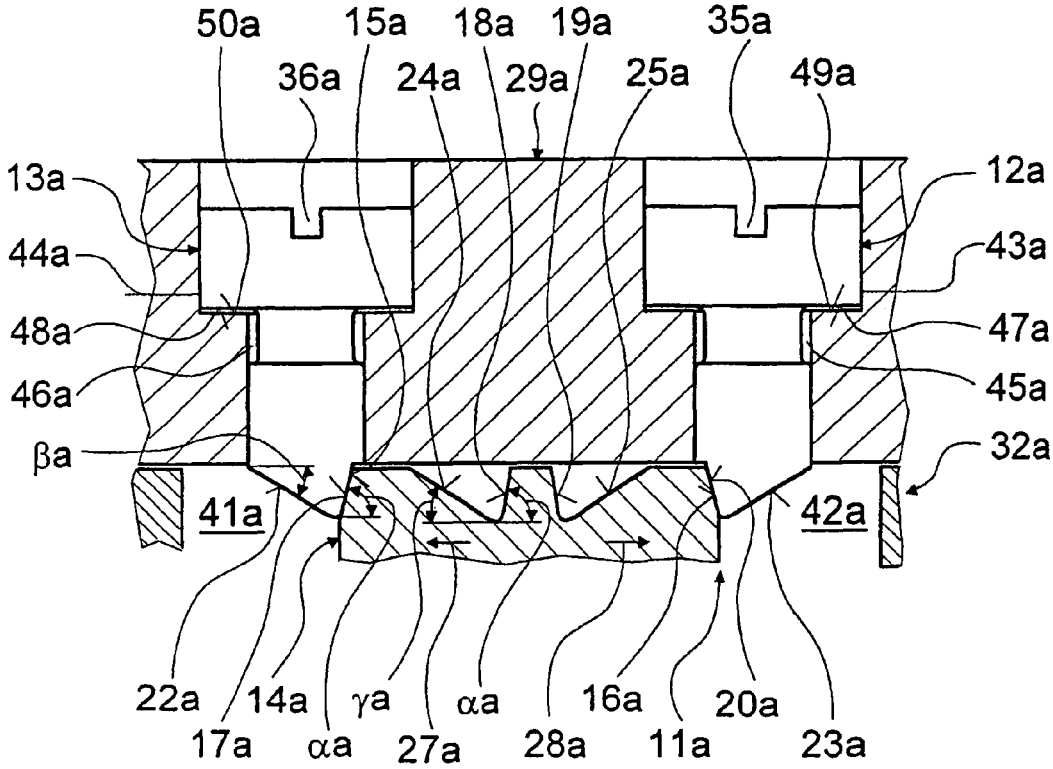
FIG. 3 shows a detail of a sectional illustration in the region of a locking means of the camshaft adjusting device of FIG. 1.

At their ends which face the adjustment function component 11*a*, which is formed by the vane piston, the locking means 12*a*, 13*a* each have an integral locking surface 15*a*, 16*a* formed by a planar inclined surface. In each case, on the side essentially opposite the locking surface 15*a*, 16*a*, a release surface 22*a*, 23*a* formed by a planar inclined surface, the locking surfaces 15*a*, 16*a* is provided which is inclined with respect to the direction of movement 27*a*, 28*a* of the adjustment function component 11*a* to a greater degree, the release surfaces 22*a*, 23*a* being inclined to a lesser degree with respect to the direction of movement 27*a*, 28*a* of the adjustment function component 11*a* (FIGS. 2 and 3). Apart from a region defined by the locking surfaces 15*a*, 16*a* and the release surfaces 22*a*, 23*a*, the locking means 12*a*, 13*a* have round cross-sectional surfaces, as a result of which these and the bearing surfaces for mounting the same can be produced cost-effectively. However, as an alternative, they could also have angled and/or polygonal cross-sectional surfaces.

In addition to the two locking means 12*a*, 13*a* formed by stepped bolts, the camshaft adjusting device has a further locking means 14*a* which is formed by a locking slotted guide and has a plurality of locking positions. The locking means is integrally formed as a single piece at an axial end face of a vane of the adjustment function component 11*a* formed by the vane piston. The locking means 14*a* has two locking surfaces 17*a*, 18*a* which are formed by planar inclined surfaces and are provided for engagement with the locking surface 15*a* of the locking means 13*a*. The locking means 14*a* has two further locking surfaces 19*a*, 20*a* which are formed by planar inclined surfaces provided for engagement with the locking surface 16*a* of the locking means 12*a*. Furthermore, the locking means 14*a* has a release surface 24*a*, which is formed by a planar inclined surface, for contact with the release surface 22*a* of the locking means 13*a*, and a release surface 25*a*, which is formed by a planar inclined surface, for contact with the release surface 23*a* of the locking means 12*a*. In this case, the release surfaces 24*a*, 25*a* and the locking surfaces 18*a*, 19*a* delimit recesses of the locking means 14*a*, which recesses have essentially negative contours of the front ends of the locking means 12*a*, 13*a*, which ends face them. The locking surfaces 17*a*, 20*a* are formed by side surfaces of the vane. As an alternative and/or in addition to the locking means 12*a*, 13*a* which are mounted moveably in the axial direction, one or more locking means which are mounted moveably in one or more other directions could also be provided, such as, in particular, locking means mounted moveably in the radial direction. Furthermore, as an alternative and/or in addition to the locking means 14*a* which is formed by a locking slotted guide and is arranged on an axial end surface of the adjustment function component 11*a*, formed by the vane piston, at least one locking means could also be provided which is formed by a locking slotted guide arranged on an end surface which is an alternative one to an axial end surface and appears expedient to a person skilled in the art, and/or is integrally formed on another component appearing expedient to a person skilled in the art.

The locking surfaces 15*a*-20*a* each have an angle of inclination $\alpha a$ of approx. 82° with respect to the direction of movement 27*a*, 28*a* of the adjustment function component 11*a* so as to be self-locking while the release surfaces 22*a*, 23*a*, 24*a*, 25*a* of the locking means 12*a*, 13*a*, 14*a* each have an angle of inclination $\beta a$ or $\gamma a$ with respect to the direction of movement 27*a*, 28*a*, of the adjustment function component 11*a* specifically avoiding self-locking. To be precise, the release surfaces 22*a*, 23*a* of the locking means 12*a*, 13*a* have a smaller angle of inclination $\beta a$ of approx. 30° in each case and the release surfaces 24*a*, 25*a* of the locking means 14*a* have a greater angle of inclination $\gamma a$ of approx. 35° in each case. However, in principle, the angles of inclination $\beta a$ and $\gamma a$ could also be designed to be the same size.

The locking means 12*a*, 13*a* are biased in the axial direction with respect to the locking means 14*a* by a common spring element 30*a* formed by a spring steel wire (FIG. 1). The spring element 30*a* extends through recesses 39*a*, 40*a* in the guide domes 37*a*, 38*a* into grooves 35*a*, 36*a* formed into the end faces of the locking means 12*a*, 13*a*, which face away from the locking means 14*a*, and guide the locking means 12*a*, 13*a* and hold them in the circumferential direction. The spring element 30*a* is shaped in such a manner that it is supported essentially at a uniform distance from the adjustment function component 29*a*.

Before an internal combustion engine with a camshaft adjusting device according to the invention is started, the adjustment function component 11*a*, which is formed by the vane piston, is locked in a play-free manner in a central position by the locking means 12*a*, 13*a* bearing by means of their locking surfaces 15*a*, 16*a* against the locking surfaces 17*a*, 20*a* of the locking means 14*a* (cf. FIG. 3). When the internal combustion engine is started, pressure chambers 41*a*, 42*a* between the vanes of the adjustment function component 11*a* and vanes of the housing 32*a*, which vanes in addition also form stops for the vanes of the adjustment function component 11*a*, are charged sequentially with pressure, and therefore the locking means 12*a*, 13*a* are moved successively out of their locking positions in the direction facing away from the locking means 14*a*. By means of their movement in the direction facing away from the locking means 14*a*, the locking means 12*a*, 13*a* open pressure channels 43*a*, 44*a*, which are indicated in FIG. 3, and therefore pressure medium can enter annular grooves 45*a*, 46*a*, which are formed by plunge-cuts, and the locking means 12*a*, 13*a* are biased in the direction of their release position via annular surfaces 47*a*, 48*a* pointing toward the locking means 14*a*, and therefore said locking means 12*a*, 13*a* are guided into their release position and are held therein. A camshaft angle relative to the crankshaft can subsequently be set via the adjustment function component 11*a* which is mounted rotatably in the housing 32*a*.

If the internal combustion engine is switched off, the oil pressure in the pressure channels 43*a*, 44*a* drops, and the locking means 12*a*, 13*a* are moved into their locking positions by the spring element 30*a* in the direction toward the locking means 14*a*. The adjustment function component 11*a* is biased by alternating torques of the camshaft but can move only stepwise either by means of the locking means 12*a* and the locking means 14*a* or by means of the locking means 13*a* and the locking means 14*a* until the adjustment function component 11*a* is finally locked in its central position by the two locking means 12*a*, 13*a* and the locking means 14*a*. If the adjustment function component 11*a* is in an end position facing the locking means 12*a* when the internal combustion engine is switched off, during a movement of the adjustment function component 11*a* in the direction of an end position facing the locking means 13*a* the locking means 12*a* basically latches first of all into the recess of the locking means 14*a*, which recess is delimited by the locking surface 19*a* and the release surface 25*a* (FIG. 3). Subsequently, a movement of the adjustment function component 11*a* into the end position facing the locking means 12*a* is prevented by the locking surfaces 16*a*, 19*a*, but a movement of the adjustment function component 11*a* into the end position facing the locking means 13*a* is permitted by the release surfaces 23*a*, 25*a*. Before the locking means 13*a* comes into contact with the locking means 14*a*, the locking means 13*a* bears by means of its annular surface 48*a* against an annular stop surface 50*a* of the adjustment function component 29*a*, which is formed by the cover, and, as a result, is secured in its position in the direction of the locking means 14*a*.

If, when the internal combustion engine is switched off, the adjustment function component 11*a* is in an end position facing the locking means 13*a*, during a movement of the adjustment function component 11*a* in the direction of the end position facing the locking means 12*a*, the locking means 13*a* basically first of all latches into the recess of the locking means 14*a*, which recess is delimited by the locking surface 18*a* and the release surface 24*a*. Subsequently, a movement of the adjustment function component 11*a* into the end position facing the locking means 13*a* is prevented by the locking surfaces 15*a*, 18*a*, but a movement of the adjustment function component 11*a* into the end position facing the locking means 12*a* is permitted by the release surfaces 22*a*, 24*a*. Before the locking means 12*a* comes into contact with the locking means 14*a*, the locking means 12*a* bears by means of its annular surface 47*a* against an annular stop surface 49*a* of the adjustment function component 29*a*, which is formed by the cover, and, as a result, is secured in its position in the direction of the locking means 14*a*. In accordance with a switching-off operation of the internal combustion engine, the adjustment function component 11*a* is locked in a play-free manner in its central position by means of the locking means 12*a*, 13*a*, 14*a* in an emergency running mode, for example if an oil pressure is too low to reliably adjust the camshaft, or if, because a cable of an electromagnetic actuator breaks, a pressure level in the pressure chambers 41*a*, 42*a* can not be controlled.

Figure 4:
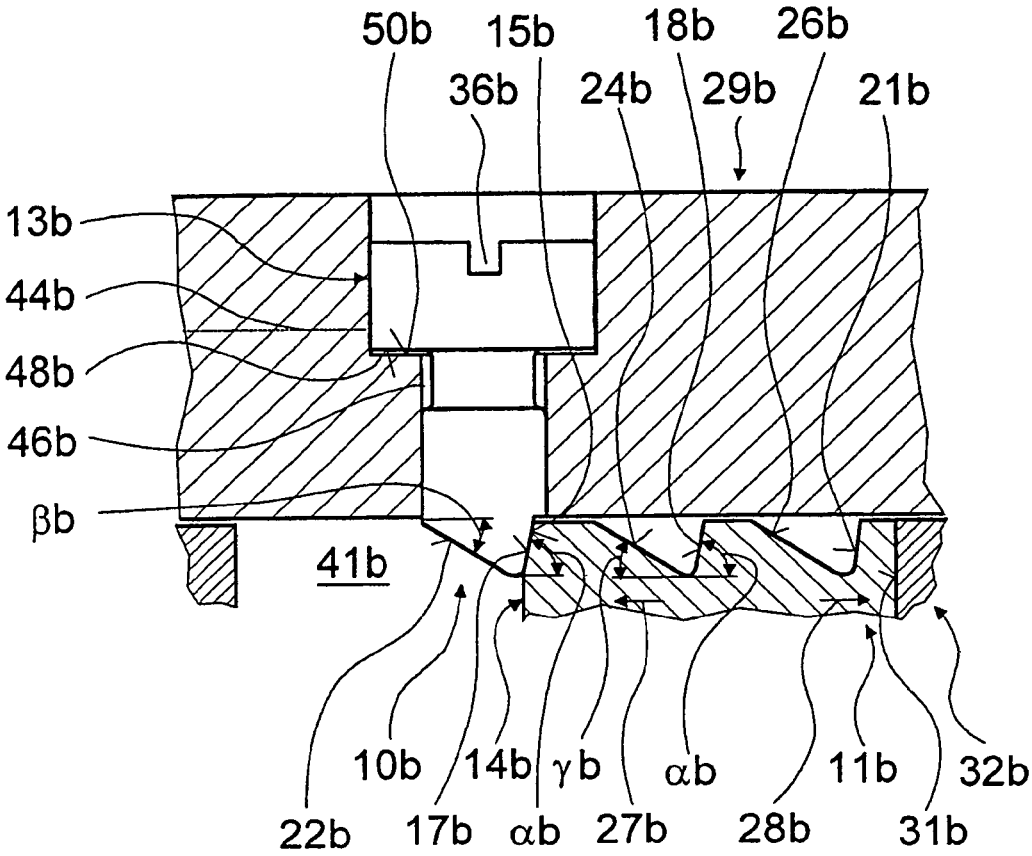
FIG. 4 shows a detail of a sectional illustration in the region of the locking means of an alternative camshaft adjusting device.

FIG. 4 illustrates a detail of an alternative camshaft adjusting device. Components which remain essentially identical are in principle numbered with the same reference numbers, with the letters a and b being added to the reference numbers in order to differentiate the exemplary embodiments. Furthermore, reference can be made to the exemplary embodiment in FIGS. 1 to 3 in respect of features and functions which remain identical. The description below is restricted essentially to the differences over the exemplary embodiment in FIGS. 1 to 3.

Instead of two moveably mounted locking means 12*a*, 13*a*, the camshaft adjusting device in FIG. 4 only has one moveably mounted locking means 13*b* which interacts with a locking means 14*b* integrally formed on an adjustment function component 11*b*.

If, when the internal combustion engine is switched off, the adjustment function component 11*b*, which is formed by a vane piston, is in an end position facing away from a stop 31*b* of a housing 32*b*, during a movement of the adjustment function component 11*b* in the direction of the stop 31*b* the locking means 13*b* basically first latches into a first recess of the locking means 14*b*, which recess is delimited by a locking surface 21*b* and a release surface 26*b*. Subsequently, a movement of the adjustment function component 11*b* in the direction facing away from the stop 31*b* is prevented by a locking surface 15*b* of the locking means 13*b* and by the locking surface 21*b* of the locking means 14*b*, but a movement of the adjustment function component 11*b* in the direction of the stop 31*b* is permitted by the release surface 26*b* of the locking means 14*b* and by a release surface 22*b* of the locking means 13*b*, and therefore, upon a subsequent movement in the direction of the stop 31*b*, the adjustment function component 11*b* can latch into a second recess of the locking means 14*b*, which recess is delimited by a locking surface 18*b* and a release surface 24*b*. Subsequently, a movement of the adjustment function component 11*b* in the direction facing away from the stop 31*b* is prevented by the locking surfaces 15*b*, 21*b*, but a movement of the adjustment function component 11*b* in the direction of the stop 31*b* is permitted by the release surfaces 22*b*, 24*b*, and therefore, upon a subsequent movement in the direction of the stop 31*b*, the adjustment function component 11*b* can latch in an end position, which faces the stop 31*b*, behind the locking means 13*b*. In the end position, the adjustment function component 11*b* bears against the stop 31*b*, which is formed by the housing 32*b*, and is locked in a play-free manner in the direction of movement 27*b* facing away from the stop 31*b*, which is formed by the housing 32*b*, by means of the locking surface 15*b* of the locking means 13*b* and a locking surface 17*b* of the locking means 14*b*.

What is claimed is:

1. A camshaft adjuster comprising a camshaft drive unit (34*a*), an adjustment function component (11*a*, 11*b*) for connection to a camshaft, the adjustment function component being mounted for rotation with the camshaft drive unit (34*a*) at an adjustable phase relationship therewith, a locking unit (10*a*, 10*b*) for locking the adjustment function component (11*a*, 11*b*) in at least one position relative to the camshaft drive unit (34*a*), the locking unit (10*a*, 10*b*) comprising at least two locking means, (12*a*, 13*a*) each having a locking surface (15*a*, 16*a*, 15*b*) and a release surface (22*a*, 23*a*, 22*b*) provided for engagement with respective engagement surfaces 18*a*, 19*a*; 24*a*, 25*a* of the locking adjustment function component (11*a*, 11*b*), said locking and release surfaces being formed by at least substantially planar inclined surfaces.

2. The camshaft adjusting device as claimed in claim 1, wherein the locking surfaces (15*a*-20*a*; 15*b*, 17*b*, 18*b*, 21*b*) extend at an angle of inclination ($\alpha a$; $\alpha b$) with respect to a direction of movement (27*a*, 28*a*; 27*b*, 28*b*) of the adjustment function component (11*a*; 11*b*) so as to obtain self-locking.

3. The camshaft adjusting device as claimed in claim 1, wherein the adjustment function component (11*a*; 11*b*) has a locking structure (14; 14*b*) with a locking slot guide and has a plurality of locking positions and at least one locking surface (15*a*-20*a*; 15*b*, 17*b*, 18*b*, 21*b*) formed by an inclined surface.

4. The camshaft adjusting device as claimed in claim 1, wherein at least one of the locking means (12*a*, 13*a*, 14*a*; 13*b*, 14*b*) has a release surface (22*a*, 23*a*, 24*a*, 25*a*; 22*b*, 24*b*, 26*b*) formed by an inclined surface having a smaller inclination than the locking surface.

5. The camshaft adjusting device as claimed in claim 1, wherein the locking unit (10*a*) has at least two locking means (12*a*, 13*a*) which are provided for locking in opposite directions of movement (27*a*, 28*a*) of the adjustment function component (11*a*; l1*b*) which is to be locked.

6. The camshaft adjusting device as claimed in claim 1, including an adjustment function component (29*a*; 29*b*) which has integrally formed bearing surfaces for supporting the locking means (12*a*, 13*a*; 13*b*).

7. The camshaft adjusting device as claimed in claim 1, comprising an adjustment function component (11*a*; 11*b*) which has an integrally formed locking slot guide.

8. The camshaft adjusting device as claimed in claim 1, comprising at least one spring element (30*a*) for guiding and for biasing at least one locking means (12*a*, 13*a*) into engagement with the adjustment function component (11*a*, 11*b*).

9. The camshaft adjusting device as claimed in claim 1, comprising at least one spring element (30*a*) for biasing a plurality of locking means (12*a*, 13*a*) into engagement with the adjustment function component (11*a*, 11*b*).

* * * * *